US009867517B2

(12) United States Patent
Krebs et al.

(10) Patent No.: US 9,867,517 B2
(45) Date of Patent: Jan. 16, 2018

(54) MULTI-FUNCTION CLEANING TOOL

(71) Applicant: BISSELL Homecare, Inc., Grand Rapids, MI (US)

(72) Inventors: Alan J. Krebs, Pierson, MI (US); Kurt E. Ashbaugh, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 317 days.

(21) Appl. No.: 14/705,226

(22) Filed: May 6, 2015

(65) Prior Publication Data

US 2015/0327741 A1 Nov. 19, 2015

Related U.S. Application Data

(60) Provisional application No. 61/993,130, filed on May 14, 2014.

(51) Int. Cl.

| | |
|---|---|
| ***A47L 7/00*** | (2006.01) |
| ***A47L 9/06*** | (2006.01) |
| ***A47L 11/40*** | (2006.01) |
| ***A47L 11/34*** | (2006.01) |

(52) U.S. Cl.

CPC ..... *A47L 11/4088* (2013.01); *A47L 7/0009* (2013.01); *A47L 9/0606* (2013.01); *A47L 11/34* (2013.01); *A47L 11/4036* (2013.01); *A47L 11/4044* (2013.01); *A47L 11/4083* (2013.01)

(58) Field of Classification Search

CPC .. A47L 7/0009; A47L 9/0606; A47L 11/4088; A47L 11/34; A47L 11/4036; A47L 11/4044; A47L 11/4083

USPC ..... 15/322, 363, 416

See application file for complete search history.

(56) References Cited

U.S. PATENT DOCUMENTS

| | | | | | |
|---|---|---|---|---|---|
| 1,016,649 | A | * | 2/1912 | Spencer | A47L 9/06 15/325 |
| 2,844,841 | A | * | 7/1958 | Bergquist | A47L 9/06 15/411 |
| 2,885,717 | A | * | 5/1959 | Lampe | A47L 9/06 15/417 |
| 5,502,870 | A | * | 4/1996 | Ragner | A47L 9/02 15/393 |
| 5,970,577 | A | * | 10/1999 | Kim | A47L 9/02 15/398 |
| 6,029,310 | A | | 2/2000 | Besel | |
| 6,038,732 | A | * | 3/2000 | McKnight | A47L 9/02 15/321 |
| 6,401,296 | B1 | | 6/2002 | McKnight et al. | |
| 6,898,820 | B2 | | 5/2005 | Kasper et al. | |

(Continued)

FOREIGN PATENT DOCUMENTS

| | | | | | |
|---|---|---|---|---|---|
| FR | 1477236 | A | | 3/1967 | |
| FR | 1477236 | A | * | 4/1967 | A47L 9/06 |
| GB | 2364499 | A | | 1/2002 | |

OTHER PUBLICATIONS

Rhodri Evans, Search Report Under Section 17(5), Aug. 20, 2015, 3 pages, South Wales.

*Primary Examiner* — Marc Carlson
(74) *Attorney, Agent, or Firm* — McGarry Bair PC

(57) ABSTRACT

A multi-function cleaning tool for use with a suction cleaner having a suction source includes a nozzle body rotatably coupled to a housing assembly, where the nozzle body includes multiple suction nozzles and/or agitators that are configured to clean different portions of a surface to be cleaned, such as a stairway.

20 Claims, 7 Drawing Sheets

(56) References Cited

U.S. PATENT DOCUMENTS

| | | | | |
|---|---|---|---|---|
| 7,073,226 | B1 | 7/2006 | Lenkiewicz et al. | |
| 7,168,129 | B2 * | 1/2007 | Smith | A47L 9/02 15/393 |
| 8,402,604 | B2 * | 3/2013 | Dant | A47L 9/0072 15/373 |
| 2013/0319469 | A1 * | 12/2013 | Borges, Sr. | A47L 9/02 134/21 |
| 2015/0320275 | A1 * | 11/2015 | Borges | A47L 9/0693 134/21 |

* cited by examiner

MULTI-FUNCTION CLEANING TOOL

CROSS REFERENCE TO RELATED APPLICATION(S)

This application claims the benefit of U.S. Provisional Patent Application No. 61/993,130, filed May 14, 2014, which is incorporated herein by reference in its entirety.

BACKGROUND

Extraction cleaners are well-known surface cleaning devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank.

Extraction cleaners for typical household use can be configured as an upright unit having a base for movement across a surface to be cleaned and an upright body pivotally mounted to a rearward portion of the base for directing the base across the surface to be cleaned, a canister unit having a cleaning implement connected to a wheeled base by a vacuum hose, or a portable extractor adapted to be hand carried by a user for cleaning relatively small areas. An example of an upright extractor is disclosed in U.S. Pat. No. 6,898,820 to Kasper et al., which is incorporated herein by reference in its entirety. An example of a portable extractor is disclosed in U.S. Pat. No. 7,073,226 to Lenkiewicz et al., which is incorporated herein by reference in its entirety. Any of the aforementioned extraction cleaners can be adapted to include a flexible vacuum hose, which can form a portion of the working air conduit between a nozzle and the suction source. Extraction cleaners can further comprise a variety of cleaning tools for selectively attaching to the end of the vacuum hose to conduct specific cleaning tasks. The cleaning tool can comprise a suction nozzle in fluid communication with the suction source and a fluid distributor fluidly connected to the fluid delivery system.

BRIEF SUMMARY

According to one aspect of the invention, a cleaning tool for a suction cleaner having a suction source includes a housing assembly with an outlet for fluid communication with the suction source, and a multi-function nozzle body rotatably mounted on the housing and having at least two suction nozzles that are fluidly isolated from each other. The at least two suction nozzles are selected from a group comprising: a straight suction nozzle, a concave suction nozzle, and an angled suction nozzle. Rotation of the nozzle body on the housing assembly selectively places one of the at least two suction nozzles in fluid communication with the outlet.

According to another aspect of the invention, a cleaning tool for a suction cleaner having a suction source includes a housing assembly with an outlet for fluid communication with the suction source, and a multi-function nozzle body rotatably mounted on the housing assembly and having at least two suction nozzle openings that are fluidly isolated from each other, with each of the at least two suction nozzle openings having an agitator. Rotation of the nozzle body on the housing assembly selectively places one of the at least two suction nozzle openings in fluid communication with the outlet. The agitators for the at least two suction nozzle openings are selected from a group comprising a straight brush, a concave brush, and an angled brush.

BRIEF DESCRIPTION OF THE DRAWINGS

The invention will now be described with respect to the drawings in which.

DESCRIPTION OF EMBODIMENTS OF THE INVENTION

The invention relates to a cleaning tool for an extraction cleaner that delivers cleaning fluid to a surface to be cleaned and extracts spent cleaning fluid and debris (which may include dirt, dust, stains, soil, hair, and other debris) from the surface. In one of its aspects, the invention relates to a cleaning tool configured to perform different cleaning functions on different portions of surface to be cleaned, such as a stairway.

Figure 1:
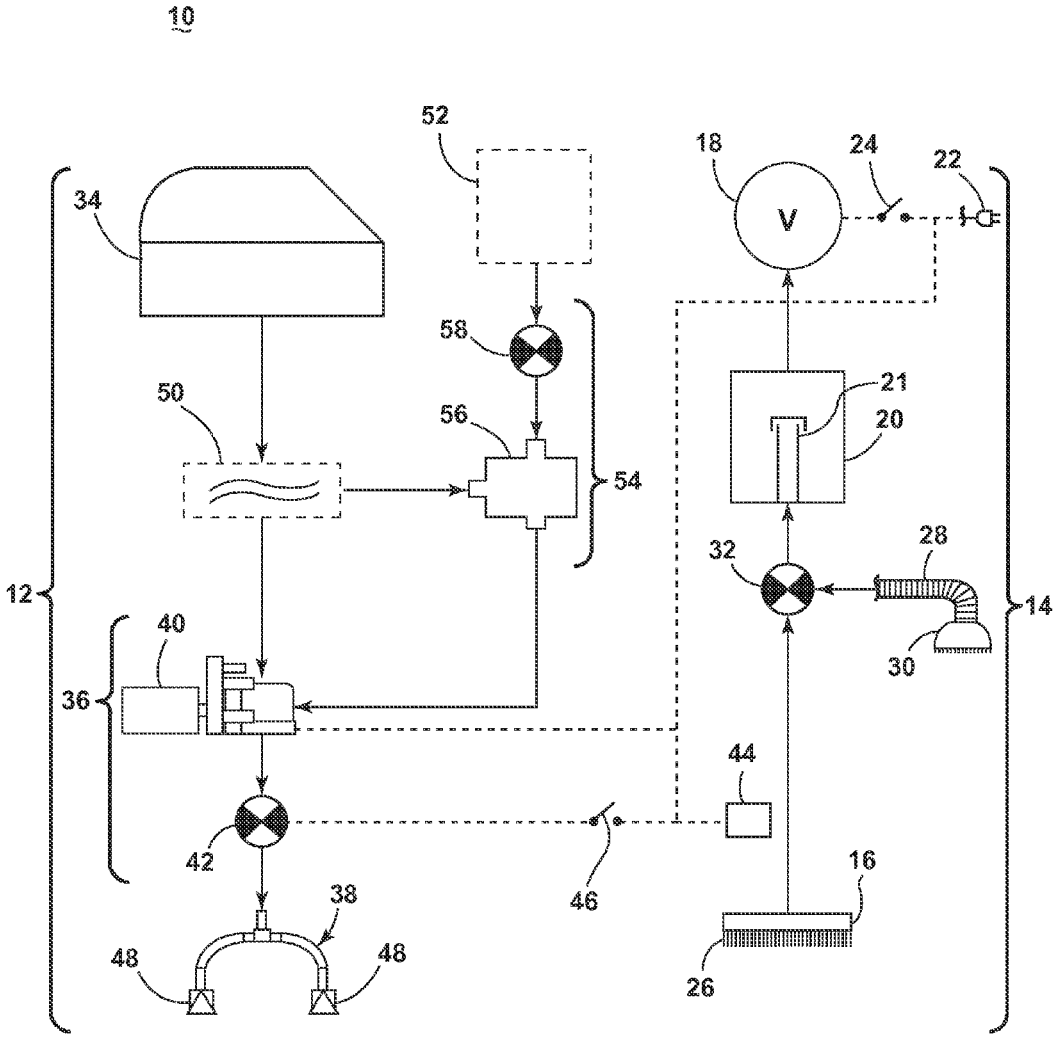
FIG. 1 is a schematic view of an extraction cleaner.

FIG. 1 is a schematic view of various functional systems of an extraction cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source 18, such as a motor/fan assembly, is provided in fluid communication with the recovery container 20. The suction source 18 can be electrically coupled to a power source 22, such as a battery or by a power cord plugged into a household electrical outlet. A suction power switch 24 between the suction source 18 and the power source 22 can be selectively closed by the user, thereby activating the suction source 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the suction source 18 for above-the-floor cleaning using an above-the floor cleaning tool 30 with its own suction inlet. A diverter assembly 32 can selectively switch between on-the-floor and above-the floor cleaning by diverting fluid communication between either the suction nozzle 16 or the vacuum hose 28 with the suction source 18.

The fluid delivery system 12 can include at least one fluid container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the container 34 to a fluid distributor 38. In one configuration, the flow control system 36 can comprise a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the distributor 38 can comprise two spray tips 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the suction source 18.

As another option, the fluid delivery system can be provided with an additional container 52 for storing a cleaning fluid. For example the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the suction source 18 prior to being exhausted from the extraction cleaner 10. The recovery container 20 can be periodically emptied of collected fluid and debris.

Figure 2:
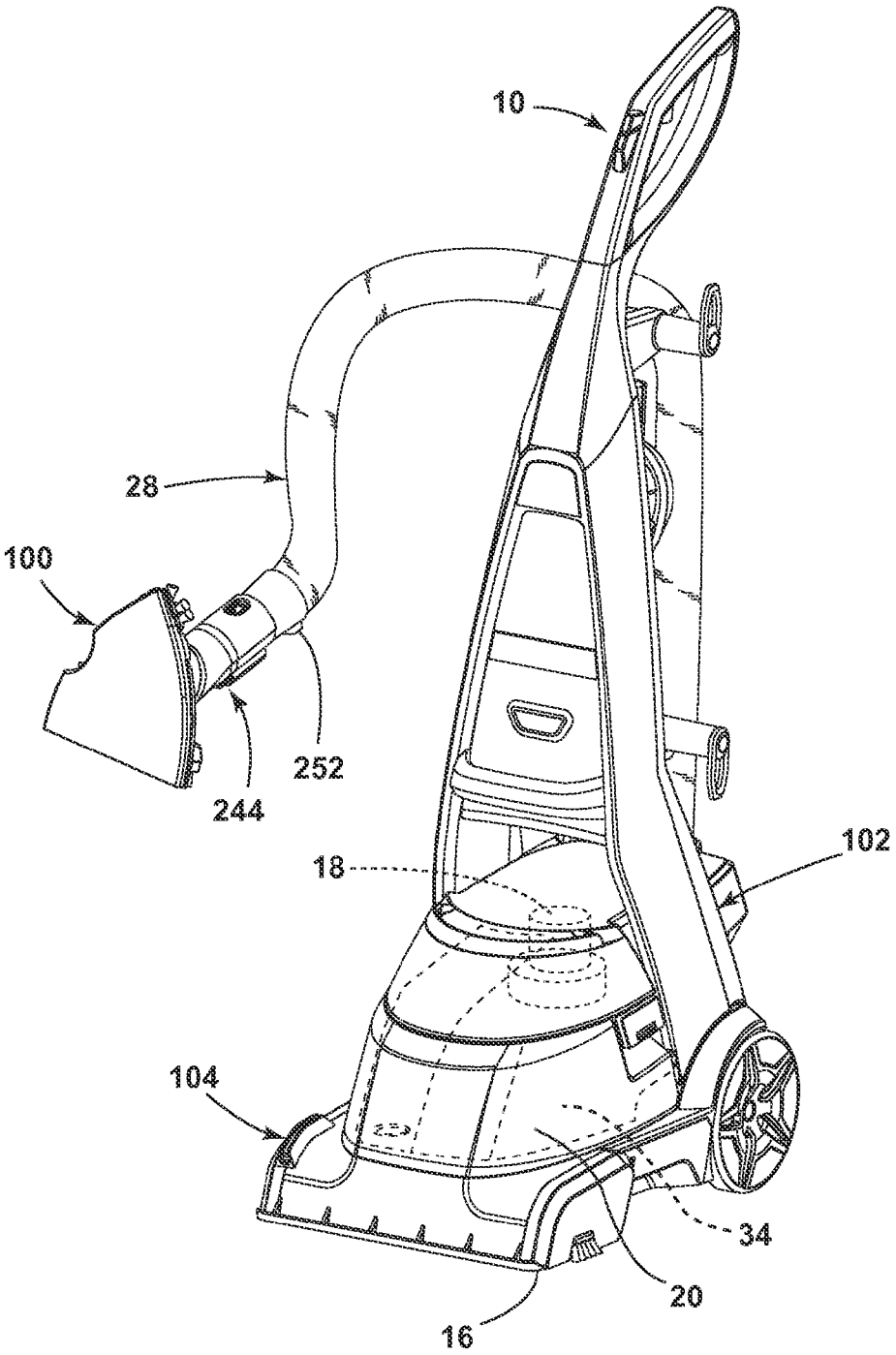
FIG. 2 is a front perspective view of an extraction cleaner with a cleaning tool according to an embodiment of the invention.

FIG. 2 is a perspective view of a cleaning tool 100 according to one embodiment of the invention attached to an extraction cleaner 10. As illustrated herein, the extraction cleaner 10 is an upright extraction cleaner having a housing that includes an upright handle assembly 102 that is pivotally connected to a base assembly 104 for directing the base assembly 104 across the surface to be cleaned. The extraction cleaner 10 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The vacuum hose 28 of the recovery system 14 is adapted to mount the cleaning tool 100 for cleaning various surfaces such as stairs, above the floor surfaces and upholstery, for example. The various systems and components schematically described for FIG. 1, including the fluid delivery system 12 and fluid recovery system 14 can be supported by either or both the base assembly 104 and the handle assembly 102.

Figure 3:
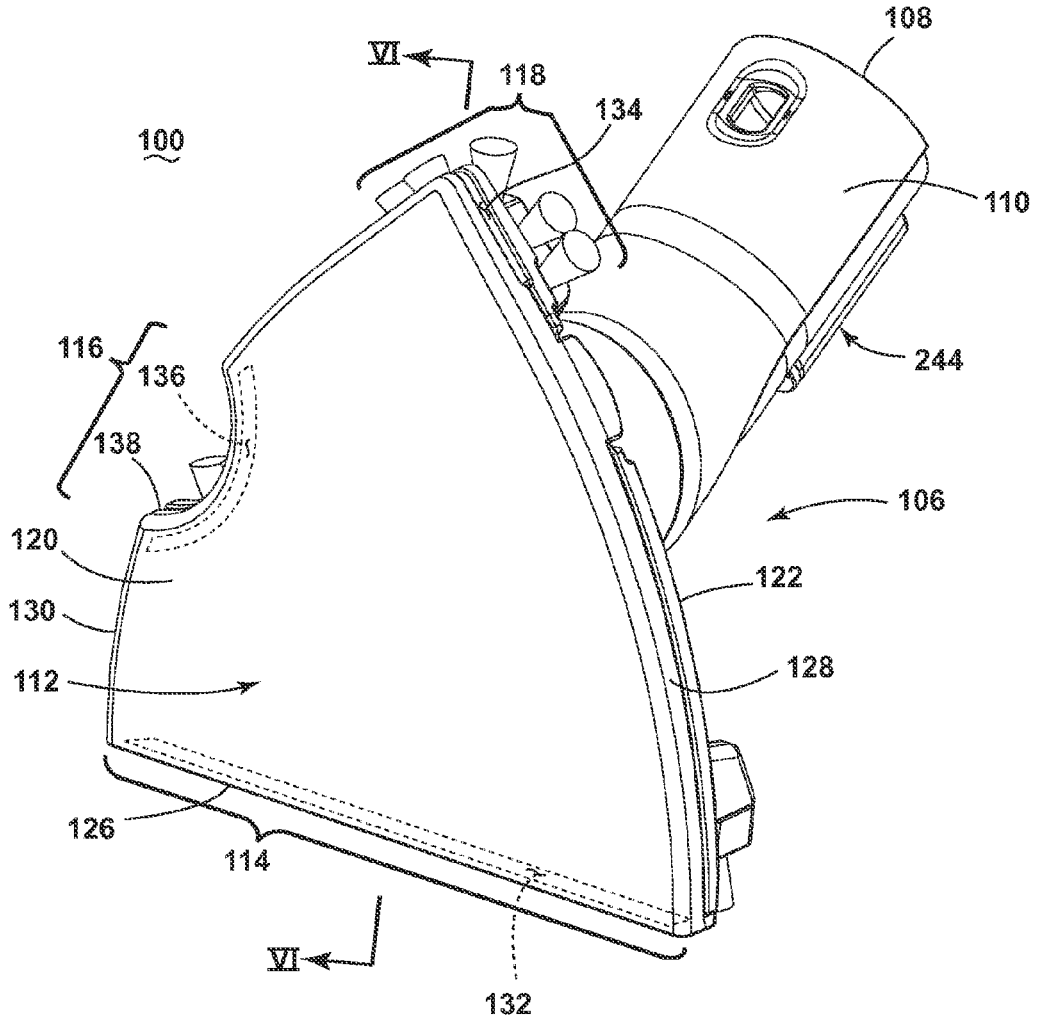
FIG. 3 is a front perspective view of the cleaning tool of FIG. 2.

FIG. 3 is a perspective view of the cleaning tool 100, which comprises a housing assembly 106 with a suction outlet 108 formed in a grip 110 that is adapted to be fluidly connected to the vacuum hose 28 and downstream suction source 18 of the extraction cleaner 10 (see FIG. 2). The housing assembly 106 further comprises a nozzle body 112 that is rotatably mounted at an opposite end of the housing assembly 106 and in fluid communication with the suction outlet 108. The nozzle body 112 can comprise a plurality of isolated suction nozzles adapted for cleaning different surfaces, each suction nozzle having a separate suction inlet opening, a separate working air channel through the nozzle body 112 and a separate suction outlet that can be selectively coupled to a suction source to draw a working air stream through the desired suction nozzle.

In the embodiment illustrated herein, the nozzle body 112 can be configured for cleaning different portions of a carpeted stairway. As shown in the figures, the nozzle body 112 can comprise an elongated flat or straight suction nozzle 114 for cleaning a flat tread of a carpeted stairway, a concave suction nozzle 116 for cleaning a rounded nose portion of the tread of a stairway, and an angled suction nozzle 118 for cleaning an inside corner portion of a stairway formed at the intersection of a stair tread and a stair riser. The suction outlet 108 can be coupled to the vacuum hose 28 to establish a working air path from one of the three suction nozzles through the vacuum hose 28, separator 21 and recovery container 20, to the suction source 18.

The nozzle body 112 comprises a nozzle cover 120 mounted to a nozzle back plate 122 forming a cavity with a plurality of working air channels therethrough. A plurality of suction inlet openings are formed in contiguous peripheral side walls of the nozzle body 112, which have been illustrated as a straight side wall 126 adjoining a first and second arcuate side wall 128, 130. The inlet openings can be defined by notches or openings between adjacent mating sidewalls of the nozzle cover 120 and nozzle back plate 122. A first inlet opening 132 is formed in the straight side wall 126 and defines an inlet to the straight suction nozzle 114. A second inlet opening 134 is formed at the junction of the first and second arcuate side walls 128, 130 and defines an inlet to the angled suction nozzle 118. A third inlet opening 136 is formed in a curved cut-out portion 138 in the second arcuate side wall 130 and defines an inlet to the concave suction nozzle 116. The curved cut-out portion 138 is preferably sized to roughly correspond to a nose portion of a stair tread. In one example, the diameter of the curved cut-out portion 138 is about 31 mm.

Figure 4:
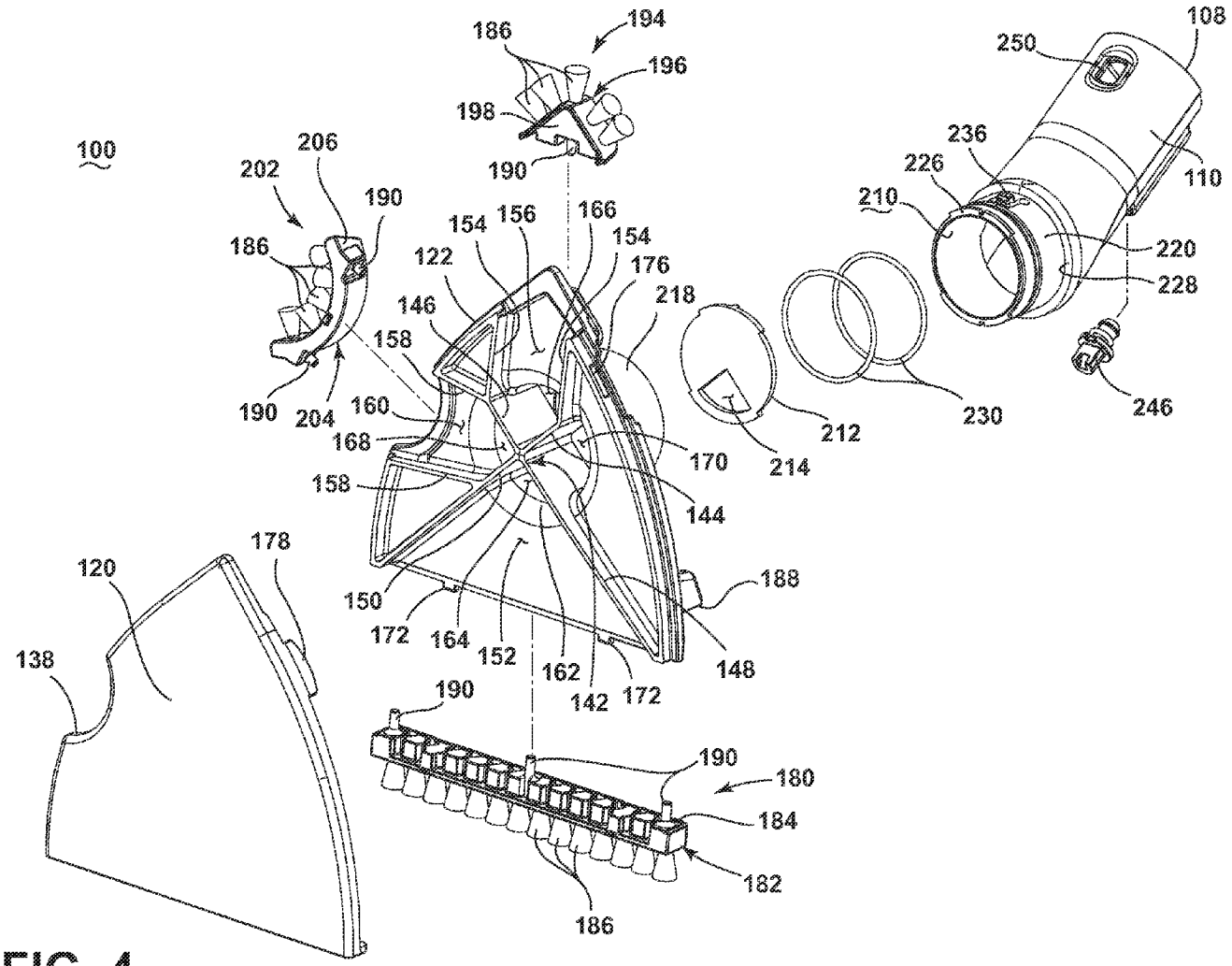
FIG. 4 is an exploded front perspective view of the cleaning tool of FIG. 3.

FIG. 4 is an exploded view of the cleaning tool 100. The nozzle back plate 122 can further comprise divider ribs that abut a rear wall of the nozzle cover 120 to divide the space between the nozzle cover 120 and nozzle back plate 122 into isolated working air channels associated with each of the different suction nozzles 114, 116, 118. As illustrated in FIG. 4, the divider ribs can comprise a substantially X-shaped rib 142 comprising an upper right rib 144, an upper left rib 146, a lower right rib 148 and a lower left rib 150, with the adjacent ribs oriented orthogonally to each other. The lower left rib 150 and lower right rib 148 partially define a first working air channel 152 that is fluidly connected to the first inlet opening 132 of the straight suction nozzle 114. The first working air channel 152 is further defined by adjacent portions of the nozzle cover 120 and nozzle back plate 122. Additional rib segments can adjoin the X-shaped rib 142 to further define working air channels through the nozzle body 112. A pair of vertical ribs 154 are spaced apart and connected to the ends of the upper right rib 144 and the upper left rib 146 to partially define a second working air channel 156 that is fluidly connected to the second inlet opening 134 of the angled suction nozzle 118. The second working air channel 156 is further defined by adjacent portions of the nozzle cover 120 and nozzle back plate 122. Likewise, a pair of lateral ribs 158 are spaced apart and connected to the left side of the X-shaped rib 142. The lateral ribs 158 extend horizontally from the end of the upper left rib 146 and from about the mid-point of the lower left rib 150 to partially define a third working air channel 160 that is fluidly connected to the third inlet opening 136 of the concave suction nozzle 116. The third working air channel 160 is further defined by adjacent portions of the nozzle cover 120 and nozzle back plate 122. Although the ribs 142, 154, 158 are shown as being formed on the nozzle back plate 122, it is contemplated that the ribs 142, 154, 158 can be formed on the nozzle cover 120, on a combination of the nozzle cover 120 and nozzle back plate 122 or by a separate component inserted between the nozzle cover 120 and nozzle back plate 122, for example.

The X-shaped rib 142 divides a circular outlet aperture 162 in the nozzle back plate 122 into a plurality of separate voids or pie-shaped outlets. As shown, a first nozzle outlet 164 is fluidly connected to the first working air channel 152 and first inlet opening 132 of the straight suction nozzle 114. A second nozzle outlet 166 is fluidly connected to the second working air channel 156 and second inlet opening 134 of the angled suction nozzle 118. A third nozzle outlet 168 is fluidly connected to the third working air channel 160 and third inlet opening 136 of the concave suction nozzle 116. Although a fourth outlet opening 170 is formed in the nozzle back plate 122, it is not associated with any suction nozzle and is therefore not utilized during any cleaning operation; however a nozzle body 112 having more than three suction nozzles is contemplated in which the fourth outlet opening 170 would be utilized.

The nozzle cover 120 is removably mounted to the nozzle back plate 122 for facile cleaning and repair. Retainer tabs 172 on the bottom of the nozzle back plate 122 are received in corresponding slots (not shown) on the nozzle cover 120. Similarly, a detent protrusion (not shown) on an inner side wall of the nozzle cover 120 nests in a corresponding detent recess 176 on a side wall of the nozzle back plate 122 and retains the nozzle cover 120 to the nozzle back plate 122. The nozzle cover 120 can further comprise a pull tab 178 for releasing the detent protrusion (not shown) from the detent recess 176 and removing the nozzle cover 120 from the nozzle back plate 122.

The cleaning tool 100 can comprise at least one agitator for scrubbing or otherwise agitating a surface to be cleaned. As shown in FIG. 4, three different agitators can be mounted on the nozzle body 112, adjacent to the three different suction nozzles 114, 116, 118. A first agitator 180 associated with the straight suction nozzle 114 can comprise a strip brush 182 with an elongate brush block 184 that mounts a plurality of bristle tufts 186. The elongate brush block 184 can be attached to an agitator mount 188 on the rear of the nozzle back plate 122. At least one mounting pin 190 on the brush block 184 is configured to be inserted into a corresponding mounting pocket 192 (see FIG. 5) in the agitator mount 188 by interference or press fit. As illustrated, there are three mounting pins 190 spaced evenly on the brush block 184 and each mounting pin 190 is inserted into a corresponding mounting pocket 192 on the agitator mount 188. When the strip brush 182 is attached to the agitator mount 188, the free ends of the bristle tufts 186 lie adjacent to the first inlet opening 132 of the straight suction nozzle 114. As shown, the free ends of the bristle tufts 186 can be positioned substantially co-planar with the straight first inlet opening 132.

A second agitator 194 associated with the angled suction nozzle 118 can comprise an angled strip brush 196 having a triangular-shaped brush block 198 that mounts a plurality of bristle tufts 186. The tufts 186 are oriented perpendicular to angled side walls of the brush block 198. A mounting pin 190 on the bottom of the triangular-shaped brush block 198 can be press fit into a second agitator mount 200 (see FIG. 5). As shown, the free ends of the bristle tufts 186 can protrude beyond or proud of the angled second inlet opening 134.

A third agitator 202 associated with the concave suction nozzle 166 comprises a concave strip brush 204 having a C-shaped brush block 206 that mounts a plurality of bristle tufts 186. The tufts 186 are oriented radially from an inner wall of the C-shaped brush block 206. Mounting pins 190 on the back of the C-shaped brush block 206 can be inserted into a third agitator mount 208 (see FIG. 5). As shown, the free ends of the bristle tufts 186 protrude beyond or proud of the concave third inlet opening 136.

Any of the first agitator 180, second agitator 194 and third agitator 202 can be configured for varying degrees of agitation by adjusting the position of the free ends of the bristle tufts 186. For example, the free ends of the bristle tufts 186 can be co-planar with the associated suction inlet opening for moderate agitation, or recessed from the suction inlet opening for less aggressive agitation. Alternatively, the free ends of the bristle tufts 186 on any of the previously described agitators can protrude beyond or stand proud of an associated suction inlet opening for more aggressive agitation.

Figure 5:
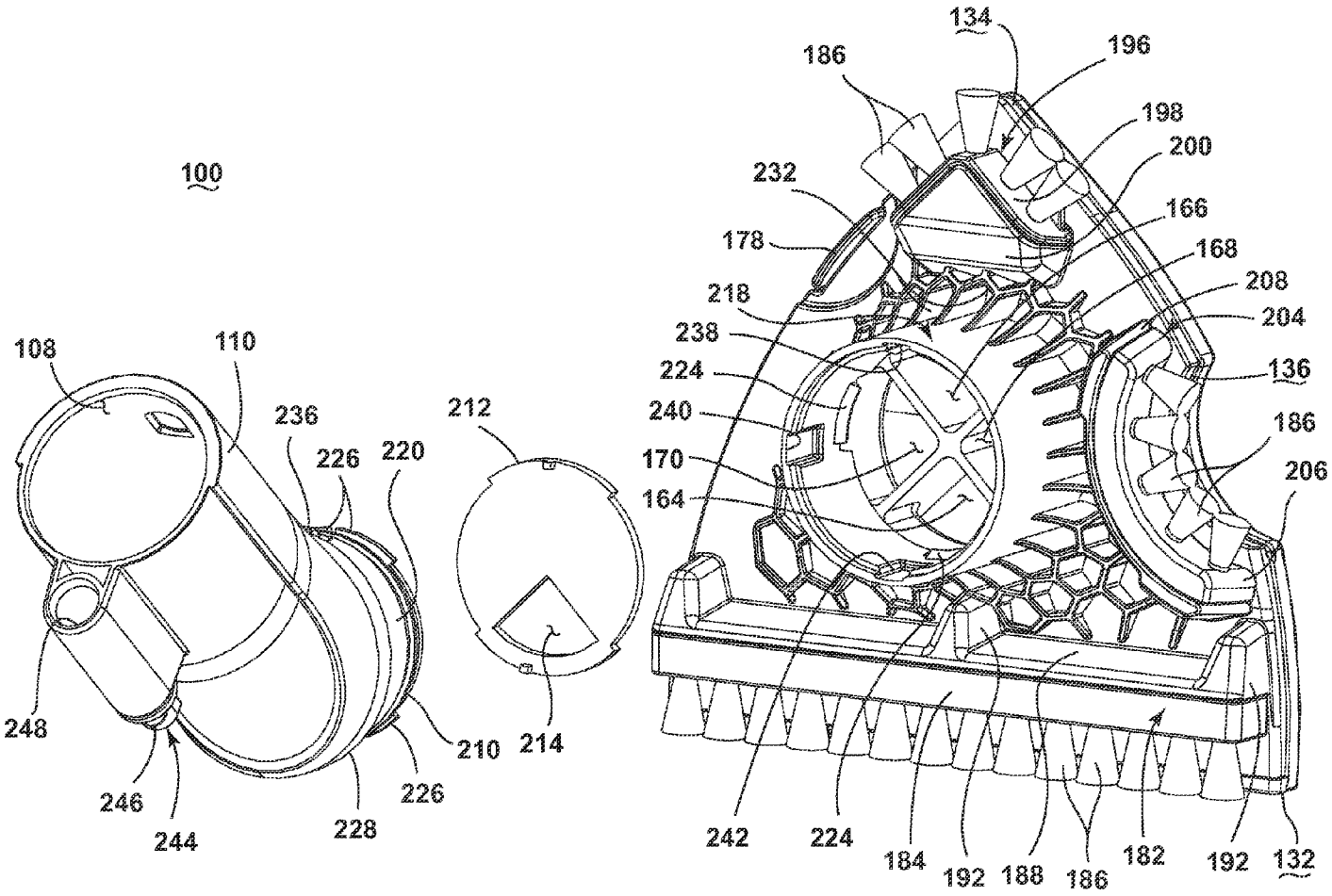
FIG. 5 is a partial exploded rear perspective view of the cleaning tool of FIG. 3.

FIG. 5 shows a partially exploded rear perspective view of the cleaning tool 100. The grip 110 defines a hollow conduit with an inlet opening 210 fluidly connected to the suction outlet 108. A valve plug 212 is adapted to partially restrict the inlet opening 210 and can be fastened to the inlet opening 210 by any suitable manufacturing method such as ultrasonic welding or adhesive, for example. A valve opening 214 through the valve plug 212 is formed by a pie-shaped aperture having approximately the same shape and dimensions as the first nozzle outlet 164, second nozzle outlet 166 and third nozzle outlet 168. The nozzle body 112 can be rotated relative to the grip 110 to selectively align one of the first nozzle outlet 164, second nozzle outlet 166 and third nozzle outlet 168 with the valve opening 214 so a working airstream can be drawn through either of the straight suction nozzle 114, angled suction nozzle 118 or concave suction nozzle 116, depending on which suction nozzle is desired for the particular cleaning task.

Figure 6:
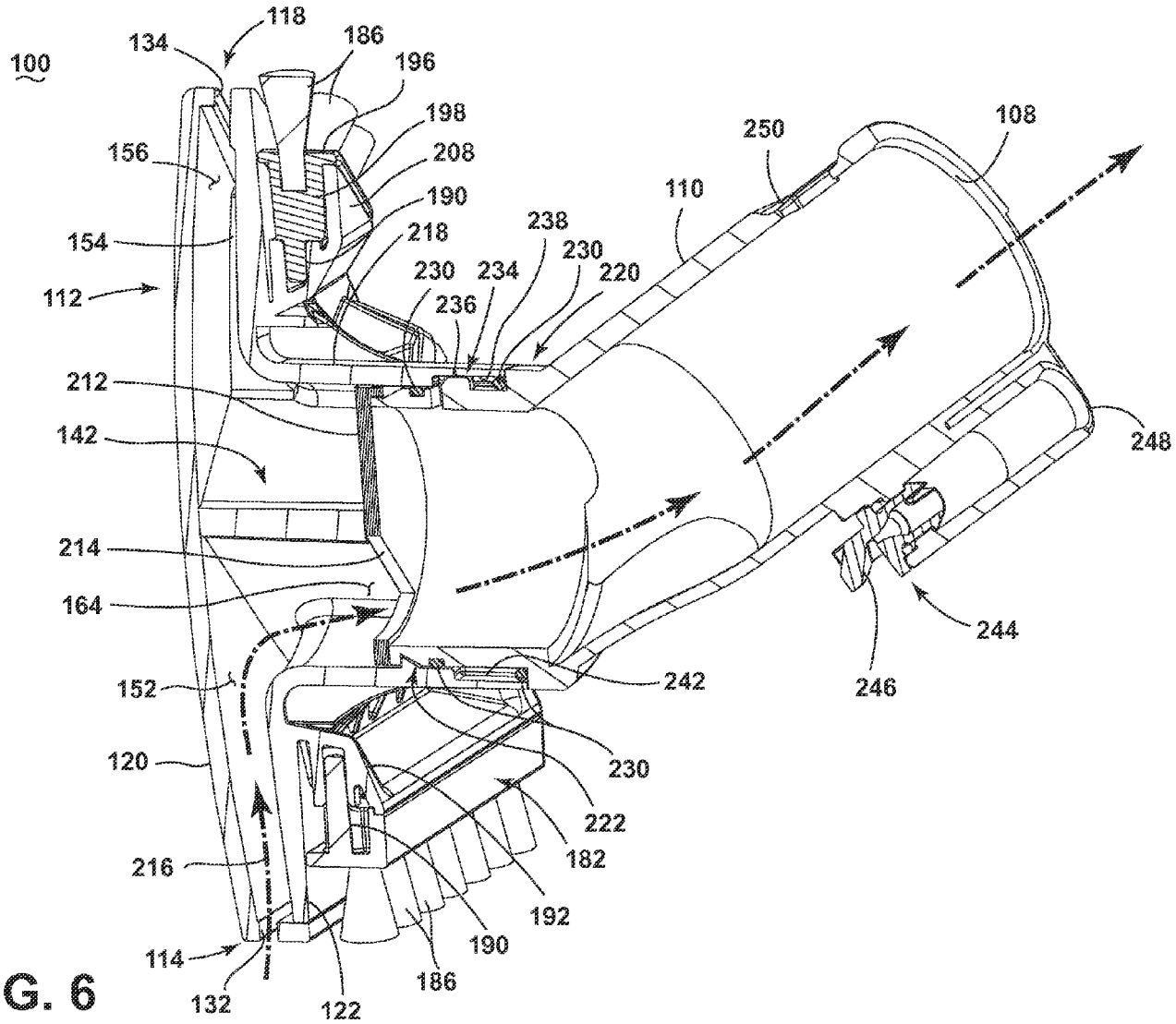
FIG. 6 is a cross-sectional view of the cleaning tool through line VI-VI of FIG. 3.

FIG. 6 shows a section view through line VI-VI of FIG. 3 to illustrate the working air path through the straight suction nozzle 114. A working airstream through the straight suction nozzle 114 is schematically illustrated as arrows 216. The nozzle body 112 is shown rotated so the straight suction nozzle 114 is forwardmost and faces downwardly, towards the surface to be cleaned. The first nozzle outlet 164 is aligned with the valve opening 214 and a working air path is established through the first inlet opening 132, the first working air channel 152, the first nozzle outlet 164, valve opening 214, the conduit in the grip 110, and finally through the suction outlet 108. When the cleaning tool 100 is connected to the vacuum hose 28, the working air path further extends through the vacuum hose 28, separator 21 and recovery container 20 and through the suction source 18 (see FIG. 1). Although not illustrated in the figure, the nozzle body 112 can be rotated so that the angled suction nozzle 118 or concave suction nozzle 116 are forwardmost and so the corresponding inlet openings 134, 136 face downwardly, toward the surface to be cleaned, which would align the valve opening 214 with the second nozzle outlet 166 or third nozzle outlet 168 corresponding to the angled and concave suction nozzle 118, 116 respectively. Thus, a working air path would be established through the desired nozzle in a similar manner.

As best shown in FIGS. 5-6 a collar 218 on the nozzle back plate 122 is rotatably coupled to a corresponding bearing 220 on the grip 110 by a retainer 222. As illustrated, the retainer 222 comprises a plurality of snaps 224 formed inside the collar 218 that engage an annular catch 226 on the bearing 220. A shoulder 228 on the grip 110 slidingly abuts the free end of the collar 218. The retainer 222 and shoulder 228 are configured to restrict axial movement of the collar 218 relative to the grip 110, while also permitting the collar 218 to rotate about the bearing 220. A seal 230 can be mounted between the bearing 220 and inside wall of the collar 218 to prevent fluid leaks between the mating parts. The seal 230 has been illustrated as a pair of O-rings. Support ribs 232 between the nozzle back plate 122 and collar 218 can support the collar 218 and can increase the strength and rigidity of the nozzle body 112. The support ribs 232 can comprise an interconnected matrix of radial, hexagonal and partial hexagonal ribs. The support ribs 232 can also be configured to support one or more of the agitator mounts 188, 200 and 208. As shown, the support ribs 232 adjoin the second and third agitator mounts 200, 208.

Figures 7A, 7B, 7C:
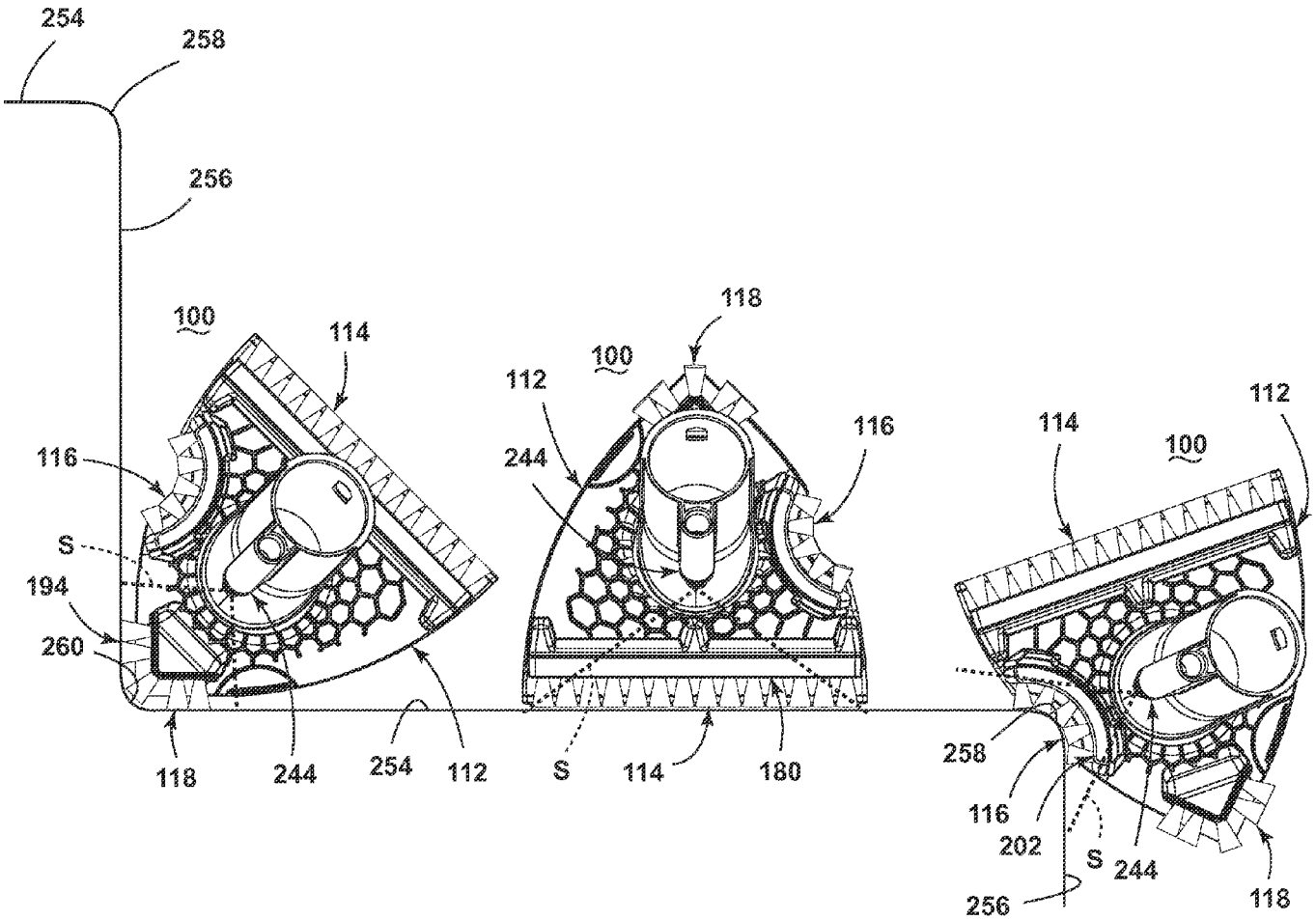
FIGS. 7A-7C are schematic views illustrating the steps of a method of cleaning different portions of a stairway using the cleaning tool of FIGS. 2-6.

A rotational detent 234 can be configured for facile indexing of the nozzle body 112 into a plurality of discrete positions relative to the grip 110 so that one of the first, second and third nozzle outlets 164, 166 and 168 can be aligned with the valve opening 214. As shown in the figures, the rotational detent 234 comprises a resilient tab 236 formed on an upper portion of the bearing 220 that is configured to selectively nest in one of a plurality of detent slots formed within the collar 218. A first detent slot 238 is positioned such that when the resilient tab 236 nests therein, the straight suction nozzle 114 is oriented downwardly, towards the surface to be cleaned as shown in FIG. 7B, and the first nozzle outlet 164 is aligned with the valve opening 214. A second detent slot 240 is positioned such that when the resilient tab 236 nests therein, the concave suction nozzle 116 is oriented downwardly, towards the surface to be cleaned as shown in FIG. 7C, and the second nozzle outlet 166 is aligned with the valve opening 214. A third detent slot 242 is positioned such that when the resilient tab 236 nests therein, the angled suction nozzle 118 is oriented downwardly, towards the surface to be cleaned as shown in FIG. 7A, and the third nozzle outlet 168 is aligned with the valve opening 214.

The cleaning tool 100 can comprise a fluid distributor 244 provided on the housing assembly 106 that is adapted to be fluidly coupled to the fluid container 34 of the fluid delivery system 12 for distributing a cleaning fluid onto the surface to be cleaned (see FIG. 1). The fluid distributor 244 has been illustrated as a spray tip 246 that is mounted within a connector 248 on the underside of the grip 110. The outlet of the spray tip 246 is oriented downwardly, toward the surface to be cleaned. And because the spray tip 246 is mounted to the grip 110, the position of the spray tip 246 does not change when the nozzle body 112 is rotated for selecting different suction nozzles. The connector 248 can mount to a fluid delivery barb (not shown) on the vacuum hose 28. A detent aperture 250 can be provided on the grip 110 for selectively securing the cleaning tool 100 to the vacuum hose 28 or to a wand (not shown) in fluid communication with the vacuum hose 28.

Referring to FIG. 2, a trigger assembly 252 can be configured to selectively actuate a pump or a valve (not shown) for selectively distributing cleaning fluid to the cleaning tool 100 and onto the surface to be cleaned. The trigger assembly 252 can be operably coupled between the fluid distributor 244 and the fluid container 34 and can be actuated by a user to distribute cleaning fluid from the fluid distributor 244, through a fluid conduit provided in the vacuum hose 28, and into the cleaning tool 100. The user can depress the trigger assembly 252 intermittently or continuously to distribute cleaning fluid until a desired amount of cleaning fluid has been applied onto the surface to be cleaned. It is understood that in some cleaning operations, the user can desire to only recover fluid from the surface to be cleaned, and in this case, cleaning fluid is not dispensed from the fluid delivery system 12.

In operation, the cleaning tool 100 is fluidly connected to the vacuum hose 28 and the suction source 18 of the extraction cleaner 10 is energized to establish a working air stream through the vacuum hose 28 and cleaning tool 100. A fluid delivery path is established from the fluid container 34 through the cleaning tool 100 such that a user can selectively dispense cleaning fluid through the fluid distributor 244 onto the surface to be cleaned by depressing the trigger assembly 252. A user can rotate the nozzle body 112 to orient the desired suction nozzle 114, 116, 118 and associated agitator downwardly, towards the surface to be cleaned. The user can then move the cleaning tool 100 across the surface to be cleaned with the desired suction nozzle 114, 116, 118 and agitator in register therewith while selectively applying cleaning fluid to deep clean the surface to be cleaned.

The operation of the straight suction nozzle 114 is similar to the operation of the angled and concave suction nozzles 118, 116. The nozzle body 112 can be rotated into the desired position, which slides the collar 218 around the bearing 220. The rotational detent tab 236 deflects as it slides on an inner wall of the collar 218 until it nests into the first detent slot 238. In this position, the straight suction nozzle 114 is indexed downwardly so that the first inlet opening 132 and first agitator 180 are oriented towards the surface to be cleaned and the first nozzle outlet 164 is aligned with the valve opening 214 so that a working airstream can be drawn through the straight suction nozzle 114.

A working airstream through the straight suction nozzle 114 is schematically illustrated as arrows 216 in FIG. 6. The working airstream can comprise entrained fluid and dirt. The working airstream 216 flows through the first inlet opening 132, first working air channel 152, the first nozzle outlet 164, the valve opening 214, the conduit in the grip 110, the suction outlet 108, the vacuum hose 28 and finally into the separator 21, where fluid and dirt are substantially separated from the working airstream 216 and retained in the recovery container 20. The separated working airstream 216 exits the recovery container 20 and flows through the suction source 18 whereupon the working airstream 216 is exhausted into the atmosphere. Additional separators or filters can be positioned upstream and or downstream from the suction source 18 to capture any remaining entrained fluid or dirt before or after the airstream flows into or out of the suction source 18.

A user can dispense cleaning fluid onto the surface to be cleaned through the fluid distributor 244 by selectively depressing the trigger assembly 252, which can open a valve or energize a pump (not shown). Additionally, a user can agitate the surface to be cleaned by scrubbing the agitator associated with the active suction nozzle on the surface to be cleaned to remove embedded or tough stains.

The function of the concave suction nozzle 116 is similar with the exception that to draw a working airstream through the concave suction nozzle 116, the nozzle body 112 must be rotated until the rotational detent tab 236 nests in the second detent slot 240 to align the second nozzle outlet 166 with the valve opening 214, which establishes a working air path from the second inlet opening 134 through the second working air channel 156, the second nozzle outlet 166, the valve opening 214, the conduit in the grip 110, and finally through the suction outlet 108 and remaining portion of the recovery system 14.

Similarly, to draw a working airstream through the angled suction nozzle 118, the nozzle body 112 must be rotated until the rotational detent tab 236 nests in the third detent slot 242 to align the third nozzle outlet 168 with the valve opening 214, which establishes a working air path from the third inlet opening 136 through the third working air channel 160, the third nozzle outlet 168, the valve opening 214, the conduit in the grip 110, and finally through the suction outlet 108 and remaining portion of the recovery system 14.

The cleaning tool 100 can be easily disassembled to clear clogs and to clean the internal portions of the tool. For example, if any of the suction nozzles 114, 116, 118 become clogged, a user can separate the nozzle cover 120 from the nozzle back plate 122 by pulling the pull tab 178 to release the detent and disengaging the retainer slots from the retainer tabs 172 on the nozzle back plate 122. After removing the nozzle cover 120 a user can easily access unclog and or clean the internal portions of the cleaning tool 100.

The cleaning tool 100 shown in FIGS. 2-6 can be used to clean a stairway in accordance with the following method, which is illustrated schematically in FIGS. 7A-7C. The sequence of steps discussed is for illustrative purposes only and is not meant to limit the method in any way as it is understood that the steps may proceed in a different order, additional or intervening steps may be included, or the described steps may be divided into multiple steps, without detracting from the invention. Using the cleaning tool 100 according to the cleaning method a user can effectively clean all exposed surfaces to be cleaned on a stairway, which is illustrated as including a horizontal tread 254, a vertical riser 256, a rounded nose 258 formed by the intersection between the front side of the tread 254 and upper portion of the riser 256, and an inside corner 260 formed by the intersection between the back side of the tread 254 and lower portion of the riser 256.

FIG. 7A shows the nozzle body 112 rotated so that the angled suction nozzle 118 is oriented downwardly, toward the surface to be cleaned. In this position, the cleaning tool 100 can be used to clean the inside corner 260 of the stairway by distributing cleaning fluid onto the inside corner 260 through the fluid distributor 244 and extracting cleaning fluid, dirt and debris therefrom through the angled suction nozzle 118. The outlet of the fluid distributor 244 is aligned with the tip of the angled suction nozzle 118 and is configured to evenly distribute the cleaning fluid in a fan-shaped spray pattern having a spray angle of about 80 degrees, as shown in dotted lines, 'S', in the figures. The second agitator 194 can be scrubbed across the inside corner 260 to remove embedded debris and tough stains.

FIG. 7B shows the nozzle body 112 rotated with the straight suction nozzle 114 oriented downwardly, toward the surface to be cleaned. In this position, the cleaning tool 100 can be used to clean the tread 254 or riser 256 portions of the stairway by distributing cleaning fluid onto the tread 254 or riser 256 through the fluid distributor 244 and extracting cleaning fluid, dirt and debris therefrom through the straight suction nozzle 114. In the drawing, the cleaning tool 100 is positioned to clean the tread 254; in order to clean the riser 256, the entire cleaning tool 100 must be rotated 90 degrees so that the straight suction nozzle 114 faces the riser 256. The outlet of the fluid distributor 244 is aligned with the centerline of the straight suction nozzle 114 and is configured to evenly distribute a fan-shaped spray pattern of cleaning fluid across the entire width of the straight suction nozzle 114 as shown in dotted lines, 'S', in the figures. The first agitator 180 can be scrubbed across the tread 254 or riser 256 to be cleaned to remove embedded debris and tough stains.

FIG. 7C shows the nozzle body 112 rotated with the concave suction nozzle 116 oriented downwardly, toward the surface to be cleaned. In this position, the cleaning tool 100 can be used to clean the nose 258 of the stairway by distributing cleaning fluid onto the nose 258 through the fluid distributor 244 and extracting cleaning fluid, dirt and debris therefrom through the concave suction nozzle 116. The fluid distributor 244 is aligned with centerline of the concave suction nozzle 116 and is configured to distribute a fan-shaped spray pattern of cleaning fluid across the width of the concave suction nozzle 116 as shown in dotted lines, 'S', in the figures. The third agitator 202 can be scrubbed across the nose 258 of the stairway to remove embedded debris and tough stains.

The cleaning tool disclosed herein provides improved functionality, flexibility and ease of use. One advantage that may be realized in the practice of some embodiments of the described cleaning tool is that three different suction nozzles are formed in a nozzle body that can be rotated relative to a stationary grip portion to rapidly switch suction nozzles for cleaning different surfaces, such as the tread, nose, riser and inner corner of a stairway. Previous cleaning tools have interchangeable inserts or rotatable adapters for varying the curvature of a single suction nozzle, but these tools can be cumbersome to adjust, can require multiple separate parts and are not as versatile as some embodiments of the described cleaning tool. In addition, the nozzle body can be easily indexed into a plurality of discrete positions defined by a rotational detent that aligns portions of the working air path so that a working airstream can be drawn through a desired suction nozzle. These features, alone or in combination, create a superior cleaning tool for extraction cleaners. Although not explicitly described, the cleaning tool herein can be applied to other types of cleaning apparatuses that incorporate fluid delivery and fluid recovery systems. For example, the cleaning tool can be applied to steam vacuum cleaners or portable extraction cleaners. The cleaning tool can also be applied to cleaning apparatuses that incorporate collection systems but not fluid delivery systems. For example, the cleaning tool can be applied to a vacuum cleaner configured to collect only substantially dry debris.

The disclosed embodiments are representative of preferred forms of the invention and are intended to be illustrative rather than definitive of the invention. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible within the forgoing disclosure and drawings without departing from the scope of the invention which is defined by the appended claims.

What is claimed is:

1. A cleaning tool for a suction cleaner having a suction source, the cleaning tool comprising:
   - a housing assembly with an outlet for fluid communication with the suction source; and
   - a multi-function nozzle body rotatably mounted on the housing assembly and comprising at least two suction nozzle openings that are fluidly isolated from each other, with each of the at least two suction nozzle openings having an agitator;
   - wherein rotation of the nozzle body on the housing assembly selectively places one of the at least two suction nozzle openings in fluid communication with the outlet; and
   - wherein the agitators for the at least two suction nozzle openings are selected from a group comprising a straight brush, a concave brush, and an angled brush;
   - wherein the at least two suction nozzle openings comprises three suction nozzle openings, and the agitators for the three suction nozzle openings comprise one straight brush, one concave brush, and one angled brush.

2. The cleaning tool according to claim 1 wherein each of the agitators comprises a plurality of bristle tufts adjacent to the associated suction nozzle opening in an orientation conforming to the shape of the associated suction nozzle opening.

3. The cleaning tool according to claim 1 wherein the housing assembly further comprises a grip defining the outlet, wherein the nozzle body can be rotated relative to the grip.

4. The cleaning tool according to claim 3 and further comprising a collar on the nozzle body that is rotatably coupled in a corresponding bearing on the grip.

5. The cleaning tool according to claim 1 and further comprising three separate working air channels through the nozzle body leading from one of the three suction nozzle openings to one of three separate suction nozzle outlets, wherein rotation of the nozzle body on the housing assembly selectively places one of the three suction nozzle outlets in fluid communication with the outlet.

6. The cleaning tool according to claim 5 and further comprising a valve plug fluidly positioned between the suction nozzle openings and the outlet, the valve plug having an opening aligned with one of the three suction nozzle outlets and adapted to block the remaining suction nozzle outlets.

7. The cleaning tool according to claim 5 wherein the nozzle body comprises a nozzle cover mounted to a nozzle back plate to form a cavity, with the working air channels extending therethrough.

8. The cleaning tool according to claim 7 wherein the nozzle cover is removable from the nozzle back plate.

9. The cleaning tool according to claim 8 wherein the nozzle cover comprises a pull tab for releasing the nozzle cover from the nozzle back plate.

10. The cleaning tool according to claim 1 wherein the nozzle body is indexible between three discrete positions such that one of the three suction nozzle openings is in fluid communication with the outlet in each discrete position.

11. The cleaning tool according to claim 10 and further comprising a rotational detent between the nozzle body and the housing assembly configured to nest in one of three slots, with each slot corresponding to one of the three discrete positions.

12. The cleaning tool according to claim 1 and further comprising a fluid distributor adapted to be fluidly coupled to a source of cleaning fluid for distributing cleaning fluid onto a surface to be cleaned.

13. The cleaning tool according to claim 12 wherein the fluid distributor comprises a spray tip mounted on the housing assembly such that the position of the spray tip does not change when the nozzle body is rotated.

14. A cleaning tool for a suction cleaner having a suction source, the cleaning tool comprising:

a housing assembly with an outlet for fluid communication with the suction source; and a multi-function nozzle body rotatably mounted on the housing assembly and comprising a straight suction nozzle, a concave suction nozzle, and an angled suction nozzle that are fluidly isolated from each other;

wherein rotation of the nozzle body on the housing assembly selectively places one of the straight suction nozzle, the concave suction nozzle, or the angled suction nozzle in fluid communication with the outlet.

15. The cleaning tool according to claim 14, wherein the housing assembly further comprises a grip defining the outlet, wherein the nozzle body can be rotated relative to the grip.

16. The cleaning tool according to claim 14 wherein each of the suction nozzles comprise separate working air channels through the nozzle body, and wherein rotation of the nozzle body on the housing assembly selectively places one of the working air channels in fluid communication with the outlet.

17. The cleaning tool according to claim 16 and further comprising a valve plug fluidly positioned between the suction nozzles and the outlet, the valve plug having an opening aligned with one of the working air channels and adapted to block the remaining working air channels.

18. The cleaning tool according to claim 14 and further comprising a fluid distributor adapted to be fluidly coupled to a source of cleaning fluid for distributing cleaning fluid onto a surface to be cleaned, wherein the fluid distributor comprises a spray tip mounted on the housing assembly such that the position of the spray tip does not change when the nozzle body is rotated.

19. A cleaning tool for a suction cleaner having a suction source, the cleaning tool comprising:

a housing assembly with an outlet for fluid communication with the suction source; and a multi-function nozzle body rotatably mounted on the housing assembly and comprising at least three suction nozzles that are fluidly isolated from each other, wherein the multi-function nozzle body comprises:

a nozzle back plate; and a nozzle cover mounted to the nozzle back plate and forming a cavity therewith having at least three isolated working air channels, wherein each of the at least three isolated working air channels is fluidly connected with one of the at least three suction nozzles;

wherein rotation of the multi-function nozzle body on the housing assembly selectively places one of the at least three suction nozzles in fluid communication with the outlet via the associated one of the at least three isolated working air channels.

20. The cleaning tool according to claim 19 and further comprising an agitator associated with each of the at least three suction nozzles.

* * * * *